US009308402B2

(12) United States Patent
Chevalier

(10) Patent No.: US 9,308,402 B2
(45) Date of Patent: Apr. 12, 2016

(54) HARNESS FOR PREVENTING A FALL AND FOR IMPROVED SUSPENSION SUPPORT

(75) Inventor: Nicolas Chevalier, St. Hilaire du Touvet (FR)

(73) Assignee: ZEDEL, Crolles (FR)

( * ) Notice: Subject to any disclaimer, the term of this patent is extended or adjusted under 35 U.S.C. 154(b) by 23 days.

(21) Appl. No.: 14/239,043

(22) PCT Filed: May 9, 2012

(86) PCT No.: PCT/FR2012/000187

§ 371 (c)(1),
(2), (4) Date: Apr. 16, 2014

(87) PCT Pub. No.: WO2012/156598

PCT Pub. Date: Nov. 22, 2012

(65) Prior Publication Data

US 2014/0353080 A1 Dec. 4, 2014

(30) Foreign Application Priority Data

May 19, 2011 (FR) ..... 11 01538

(51) Int. Cl.
*A62B 35/00* (2006.01)

(52) U.S. Cl.
CPC ..... *A62B 35/0018* (2013.01); *A62B 35/00* (2013.01); *A62B 35/0025* (2013.01); *A62B 35/0037* (2013.01)

(58) Field of Classification Search
CPC ..... A62B 35/00; A62B 35/0006; A62B 35/0018; A62B 35/0025
USPC ..... 182/3, 6
See application file for complete search history.

(56) References Cited

U.S. PATENT DOCUMENTS

| | | | | |
|---|---|---|---|---|
| 2,979,028 | A * | 4/1961 | Zakely | 182/3 |
| 8,025,192 | B2 * | 9/2011 | Petzl et al. | 224/223 |
| 2005/0067221 | A1 * | 3/2005 | Wolner et al. | 182/3 |
| 2005/0092546 | A1 * | 5/2005 | Hsu | 182/6 |
| 2007/0209868 | A1 * | 9/2007 | Betcher et al. | 182/3 |
| 2007/0256890 | A1 | 11/2007 | Petzl | |
| 2010/0200329 | A1 | 8/2010 | Johnson et al. | |
| 2011/0017546 | A1 | 1/2011 | Nichols, Jr. | |

(Continued)

FOREIGN PATENT DOCUMENTS

| | | | |
|---|---|---|---|
| FR | 2 900 579 | A1 | 11/2007 |
| WO | WO 2005/025676 | A1 | 3/2005 |

OTHER PUBLICATIONS

Written Opinion of the International Searching Authority issued in International Patent Application No. PCT/FR2012/000187 mailed Aug. 30, 2012.

*Primary Examiner* — Alvin Chin-Shue
*Assistant Examiner* — Kristine Florio
(74) *Attorney, Agent, or Firm* — Oliff PLC

(57) ABSTRACT

The invention relates to a roping harness including a belt, a pair of leg loops, front and rear shoulder straps including at least one fall-arresting safety hooking point on the back, the rear shoulder straps being capable of sliding freely in the belt, while being attached by their lower ends to the leg loops. The back part of the belt is connected to the front shoulder straps by connecting means while being disconnected from the back hooking point. This results in holding the belt in place while preventing it from slipping when it must bear a certain weight of equipment, and a transfer of the load to the straps of the leg loops to the back hooking point during a fall.

7 Claims, 7 Drawing Sheets

(56) References Cited

U.S. PATENT DOCUMENTS

2012/0048646 A1* 3/2012 Harris, Jr. ..... 182/6
2012/0228056 A1* 9/2012 Lang et al. ..... 182/3
2013/0025968 A1* 1/2013 Smith et al. ..... 182/3

* cited by examiner

HARNESS FOR PREVENTING A FALL AND FOR IMPROVED SUSPENSION SUPPORT

TECHNICAL FIELD OF THE INVENTION

The invention relates to a roping harness including a belt, a pair of leg loops, front and rear shoulder straps including at least one fall-arresting safety hooking point on the back, said rear shoulder straps being capable of sliding freely in the belt, while being attached at the lower ends thereof to the leg loops.

Such a harness is used for fall-arresting and suspension purposes during suspended work using the back hooking point.

BACKGROUND OF THE INVENTION

In the known harnesses of the aforementioned type, a locking device situated upstream holds the user quasi-instantaneously after a fall. This results in an upward reaction on the back hooking point that tends to cause the belt to rise up on the user's ribs. This drawback is due on the one hand to the tight connection between the rear shoulder straps and the belt, and on the other hand the loose connection between the belt and the leg loops.

To resolve this, it has already been proposed to fasten the lower ends of the rear shoulder straps directly to the leg loops, and to equip the belt with guide means allowing a relative sliding movement of the rear shoulder straps with respect to the belt. This sliding strap system keeps the belt from rising up upon impact, but does not prevent it from slipping when it is biased by weight, in particular tools or other loads hooked to the equipment holder of the belt.

Furthermore, excessive tightening of the shoulder straps connected to the belt causes the latter to rise. This results in a certain degree of discomfort when suspended by the back hooking point, and untimely rising of the belt during tightening of the shoulder straps.

BRIEF DESCRIPTION OF THE INVENTION

The aim of the invention is on the one hand to improve the safety of harnesses for fall prevention and suspension via the back hooking point, and on the other hand to prevent the belt from rising inappropriately when the shoulder straps are tightened.

In addition to the connection of the sliding rear shoulder straps to the leg loops, the invention is characterized in that the back part of the belt is connected to the front shoulder straps by connecting means while being disconnected from the back hooking point.

This results in the following dual function:

- maintaining the belt while preventing it from slipping when it mast bear a certain equipment weight;
- transferring the load to the leg loop straps to the back hooking point when a fall occurs, which prevents the belt from rising up around the user's ribs.

These two functions are independent of one another, while allowing optimal support for the user.

The connecting means are configured to react the load of the belt on the front shoulder straps. They are made either from a second pair of rear shoulder straps interconnected between the belt and the front shoulder straps, or from at least one piece of fabric sewn to the back part of the belt, and connecting the front shoulder straps. The piece of fabric may advantageously be lined to provide a pair of guide sheaths passed through by the sliding rear shoulder straps.

The back hooking point may be stationary while being directly connected with the leg loops via the rear shoulder straps.

The back fastening point may also be connected to the leg loops by means of an adjusting strap inserted between two branches of the rear shoulder straps, so that their height can be adjusted based on the user's morphology.

Preferably, the back hooking point is located in the rounded part of a metal buckle, additionally having a first cross-piece for folding the V-shaped strap of the rear shoulder straps, and a second parallel cross-piece for folding the V-shaped strap of the front shoulder straps.

BRIEF DESCRIPTION OF THE DRAWINGS

Other features and advantages will emerge more clearly from the following description of one embodiment of the invention provided as a non-limiting example and illustrated in the appended drawings, in which.

DETAILED DESCRIPTION OF THE INVENTION

Figure 1:
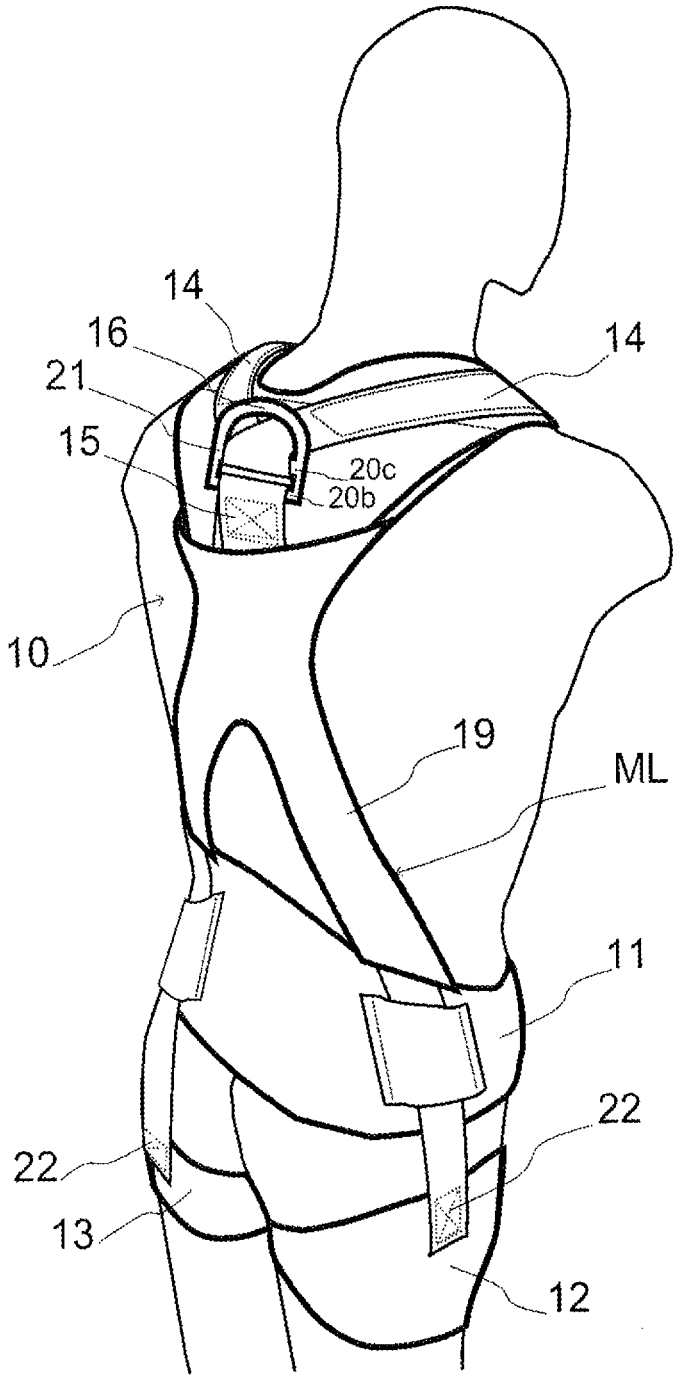
FIG. 1 is a diagrammatic perspective view of the rear part of a harness according to the invention, with a first embodiment of the means for connecting the belt to the front shoulder straps.
Figure 2:
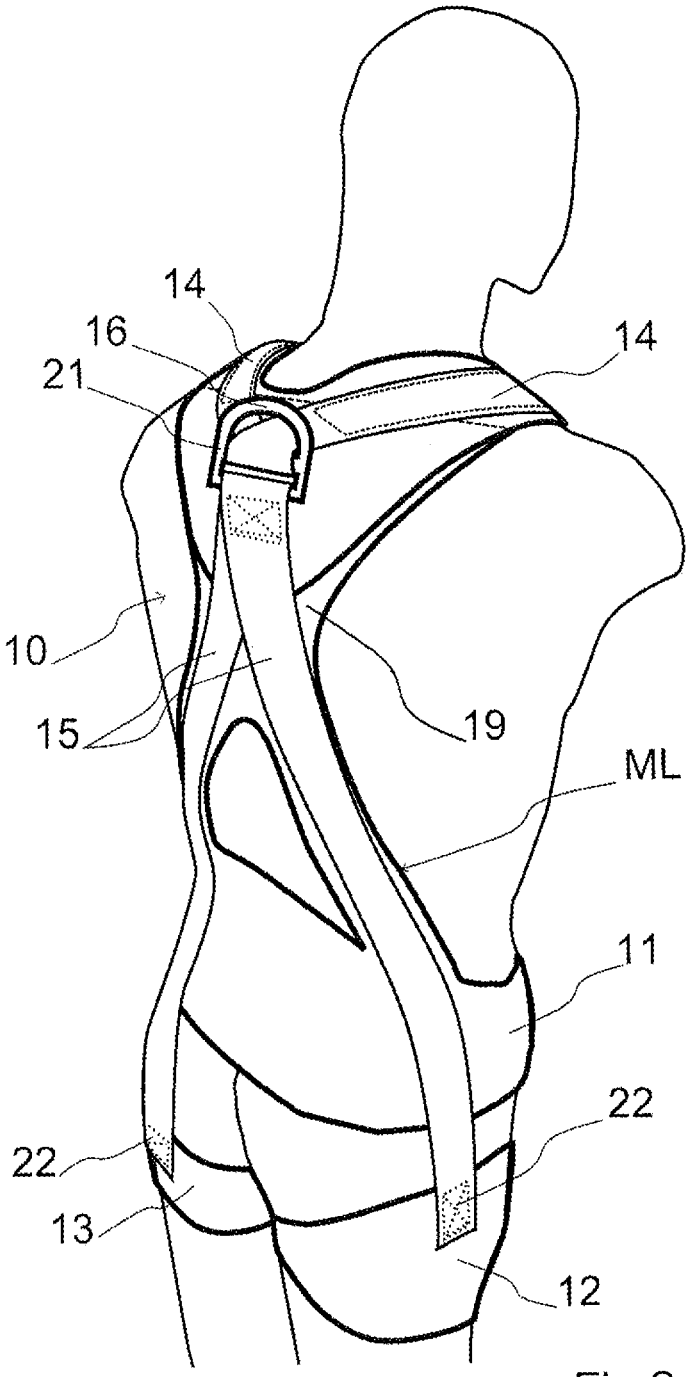
FIG. 2 is a view identical to FIG. 1 of an alternative embodiment, in which the connecting means are made up of a second set of rear shoulder straps arranged below the first sliding rear shoulder straps.

FIGS. 1 to 5 show a rope and harness 10 made up of a belt 11 designed to surround a user's waist, a pair of leg loops 12, 13, a set of front 14 and rear 15 shoulder straps, and a fall-arresting back hooking point 16. The front part (not shown) of the harness 10 includes a ventral hooking point connected to the belt 11, and optionally a sternal hooking point connected to the front shoulder straps 14. Such a harness is well known by specialists, and is described in document FR2900579. It makes it possible to perform both a fall-arresting function and a maintaining function during work.

The back hooking point 16 is located at the connecting area of the front and rear shoulder straps 14, 15, situated at the upper part of the user's back. The two rear shoulder straps 15 are made up of a strap folded in an upside down V from the back hooking point 16, and the lower ends of said shoulder straps are secured directly by seams 22 to the two leg loops 12, 13, but not the belt 11. In case of fall, the user is stopped automatically by the locking of the upstream fall-arresting device (not shown), causing an upward reaction on the back hooking point 16. This reaction is passed on to the two leg loops 12, 13, preventing the belt 11 from rising.

Figure 5:
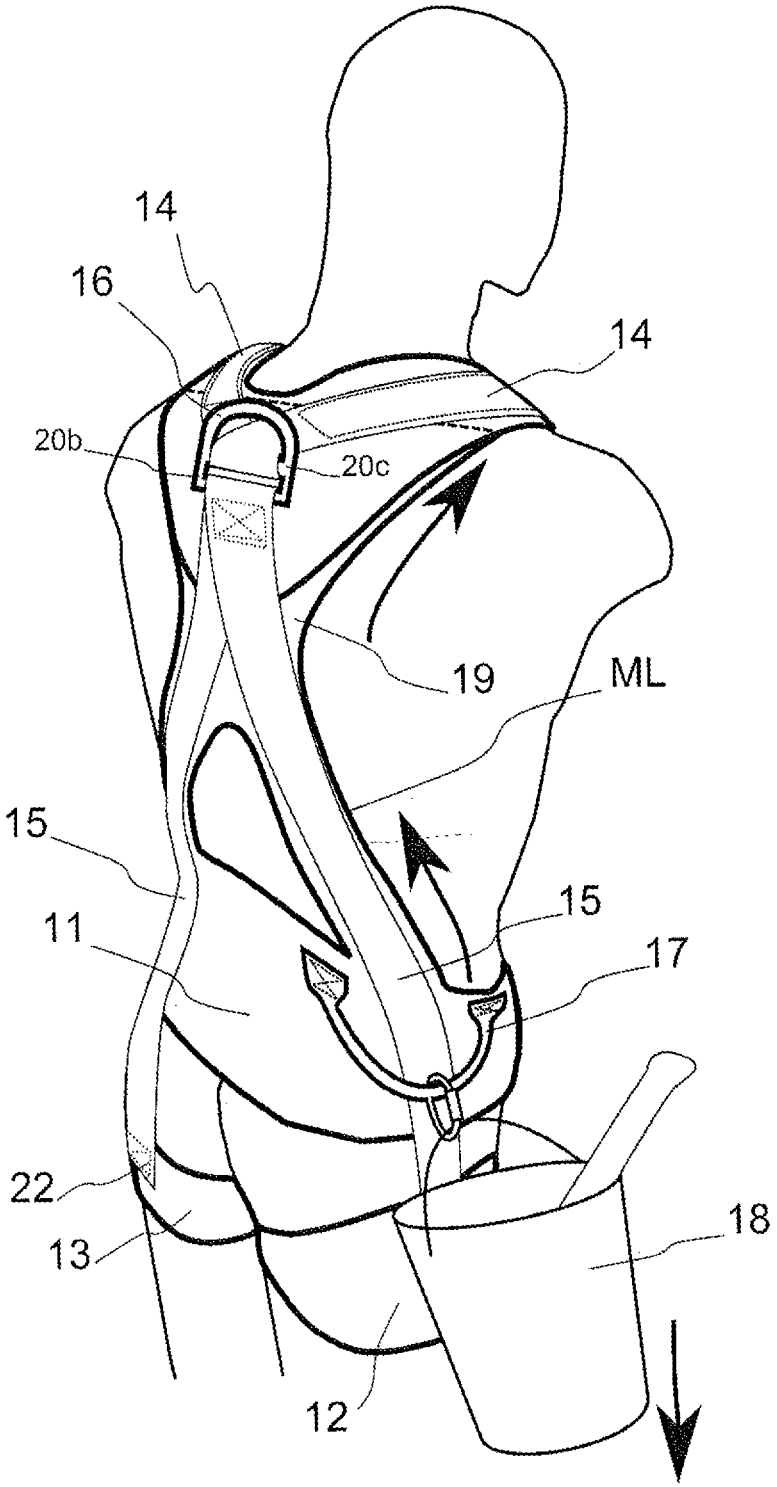
FIG. 5 illustrates the harness of FIG. 2, when the belt bears a tool or other load having a certain weight.

The back part of the belt 11 is connected to the front shoulder straps 14 by connecting means ML designed to avoid any downward movement of the belt 11 when it is loaded with a certain weight. In FIG. 5, the equipment holder 17 of the belt 1 for example bears a container 18 filled with water, or any other load (safety or worksite equipment). The presence of the connecting means ML for connecting the belt

11 to the front shoulder straps 14 makes it possible to keep the belt 11 in its normal position, by preventing untimely slipping under the effect of the weight.

The connecting means ML may be arranged in different forms:

either an additional pair of interconnected straps between the back part of the belt 11 and the upper ends of the front shoulder straps 14;

or an X-shaped piece of fabric 19 sewn into the back part of the belt 11, and connecting the front shoulder straps 14.

The piece of fabric 19 may advantageously be lined to form a pair of guide sheaths (FIGS. 1 and 3) in the form of an upside down V, crossed through by the sliding rear shoulder straps 15.

Figure 4:
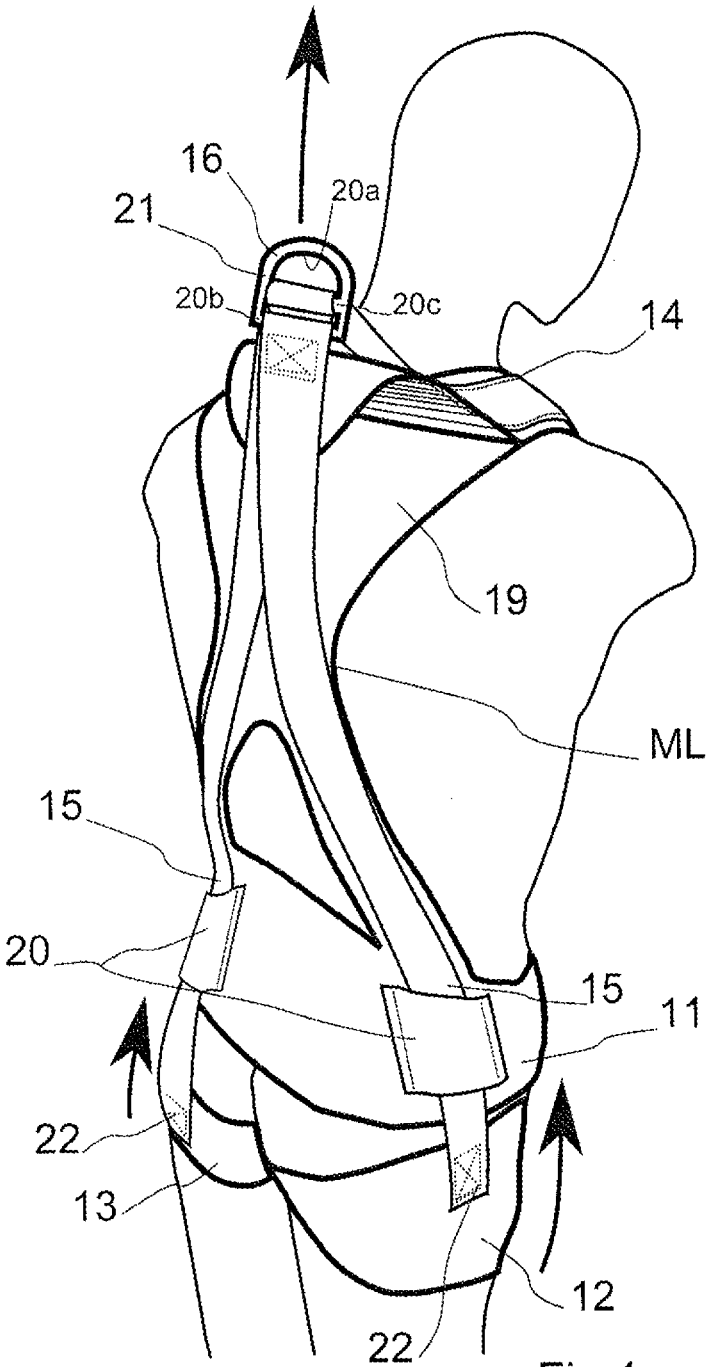
FIG. 4 shows the harness of FIG. 2 when the back hooking point is biased upward during a fall.

In FIG. 4, the belt 11 may be provided on the sides with a pair of loops 20 passed through by the two sliding rear shoulder straps 15. According to one alternative embodiment, the V-shaped strap of the two rear shoulder straps 15 may also pass between the padding of the belt 11 and the safety strap thereof.

The back hooking point 16 is located in the rounded part 20*a* of a metal buckle 21, additionally having a first cross-piece 20*b* for folding the V-shaped strap of the rear shoulder straps 15, and a second cross-piece 20*c* for folding the V-shaped strap of the front shoulder straps 14.

The operation of the harness according to FIGS. 1-5 clearly emerges from the preceding description.

Figure 3:
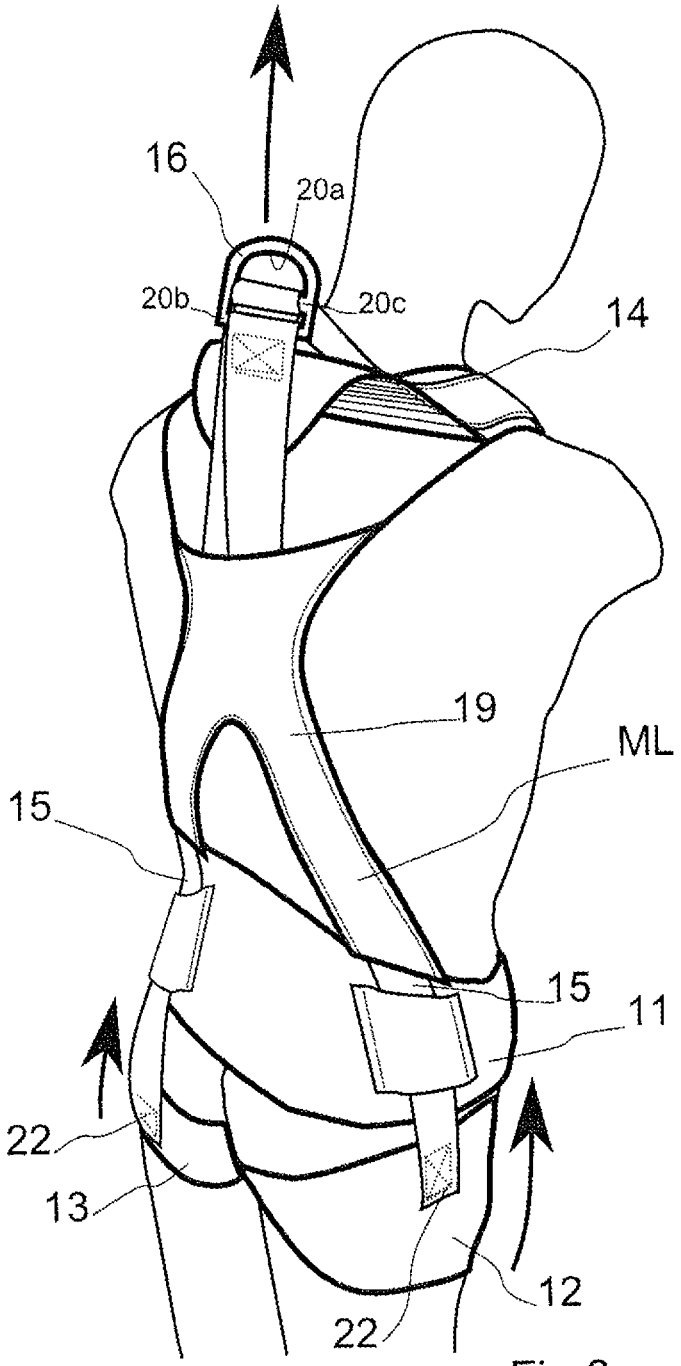
FIG. 3 shows the harness of FIG. 1 when the back hooking point is biased upward during a fall.

In FIGS. 3 and 4, it is possible to see the transfer of the load en the leg loops 12, 13 to the back hooking point 16 when a fall occurs. The belt 11 does not rise owing to the free sliding of the rear shoulder straps 15.

In FIG. 5, the belt 11 also remains in place without slipping downward when it is loaded with the container 16 filled with water. User support is thus optimal in both of the aforementioned situations.

Figure 6:
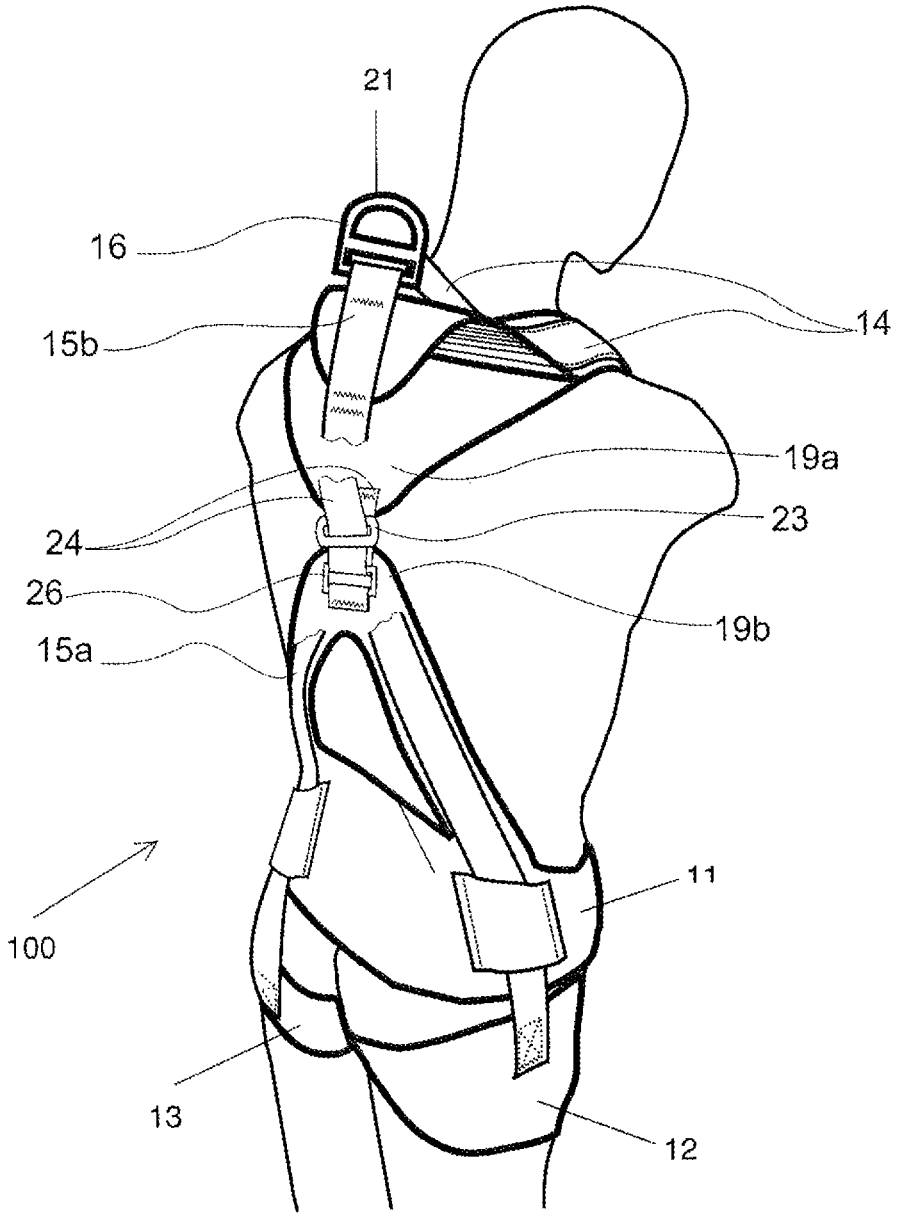
FIGS. 6 and 7 show an alternative embodiment with a system for adjusting the height of the fail-arresting back hooking point.
Figure 7:
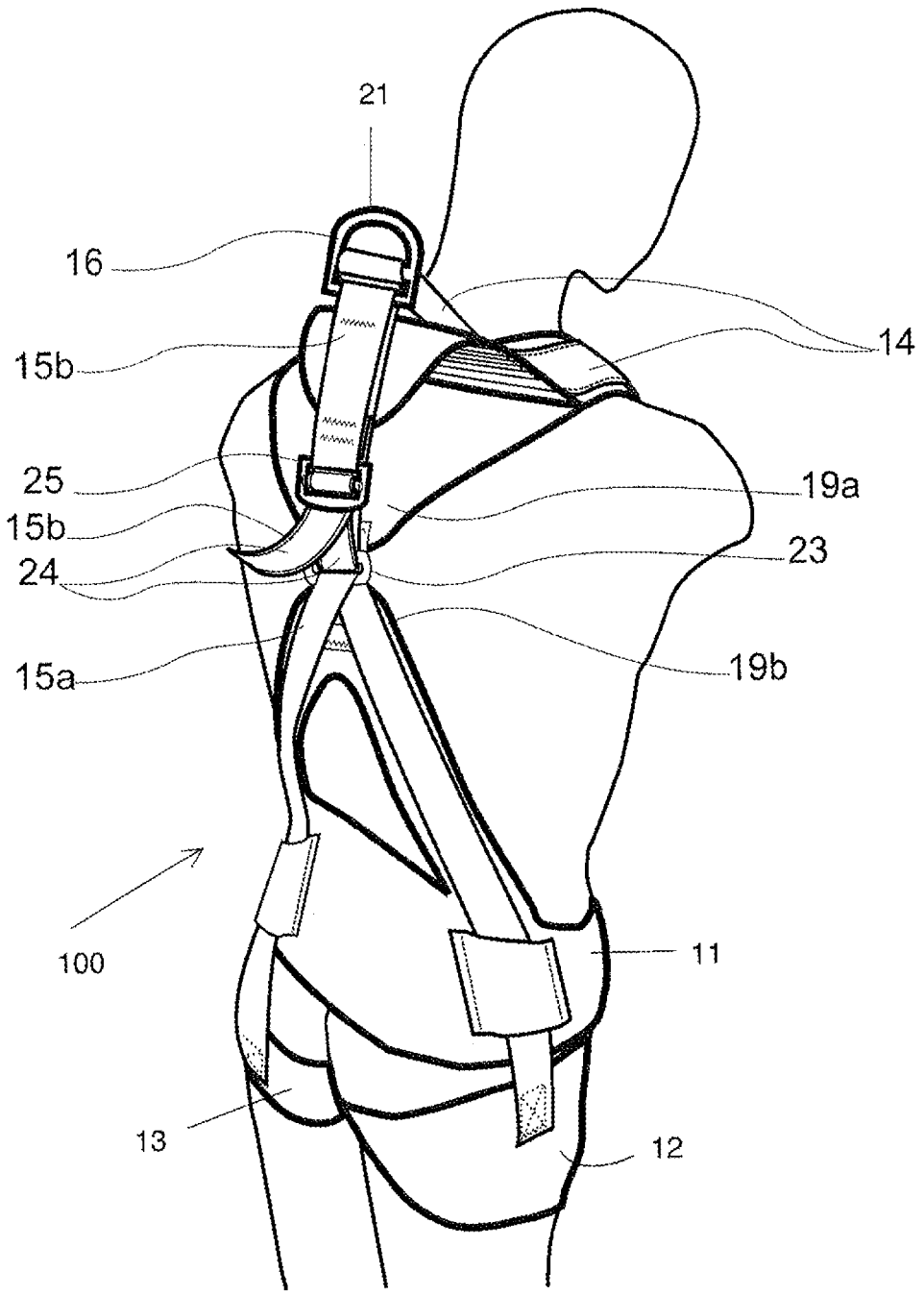

In reference to the alternative of the harness 100 in FIGS. 6 and 7, the back hooking point 16, instead of being stationary as in the version of FIGS. 1 to 5, may be adjusted heightwise based on the morphology of the user. The structure of the harness 100 is modified as follows:

the two strap branches 15*a* and 15*b* result from the separation of the rear connecting straps between the back hooking point 16 and the leg loops 12, 13.

19*a* and 19*b* are two connecting elements resulting from the separation of the piece of fabric 19, to allow the adjustment.

23 is a metal ring ensuring sliding of the straps 15*a* and 24.

24 is an additional adjusting strap that makes it possible to adjust the shoulder strap connection relative to the belt 11 via the two elements 19*a* and 19*b*.

25 is a metal adjusting buckle in which the two straps 15*b* and 24 pass.

26 is a metal buckle (for example) allowing sliding of the adjusting strap 24.

A simultaneous dual adjustment is thus obtained, on the one hand of the connection of the back hooking point 16 relative to the leg loops 12, 13, and on the other hand of the connecting shoulder straps relative to the belt 11. This dual adjustment makes it possible to adjust the height of the back fall arresting point as a function of the morphology of the user while retaining the independence of the connections of the back hooking point 16 relative to the leg loops 12, 13, and rear shoulder straps 15 relative to the belt 11.

The invention claimed is:

1. A roping harness comprising:

a belt having a back part and a material holder for supporting equipment;

a pair of leg loops;

front shoulder straps and rear shoulder straps;

at least one fall-arresting safety hooking point at an upper back connecting area of the front shoulder straps and the rear shoulder straps, said rear shoulder straps having lower ends attached to the leg loops and being freely slidable relative to the belt so as to prevent the belt from rising when a fall occurs; and connecting means connecting the back part of the belt to the front shoulder straps, the rear shoulder straps being movable relative to the connecting means, said connecting means being configured to transfer a load of the belt to the front shoulder straps, so as to avoid any downward movement of the belt when said material holder is loaded, wherein the connecting means are made up of at least one piece of fabric sewn to the back part of the belt, the at least one piece of fabric directly connecting the front shoulder straps to the back part of the belt, and said at least one piece of fabric is lined to provide a pair of guide sheaths, the rear shoulder straps slidably passing through the guide sheaths.

2. The harness according to claim 1, wherein the safety hooking point is directly connected with the leg loops via the rear shoulder straps.

3. The harness according to claim 1, wherein the safety hooking point is connected to the leg loops by means of an adjusting strap inserted between two branches of the rear shoulder straps, so that a height of the safety hooking point can be adjusted based on morphology of a user.

4. The harness according to claim 1, wherein the connecting means include a second pair of rear shoulder straps interconnected between the belt and the front shoulder straps.

5. The harness according to claim 1, wherein the safety hooking point is located in a rounded part of a metal buckle, the metal buckle additionally having a first cross-piece for folding the rear shoulder straps to form a first V-shaped strap, and a second parallel cross-piece for folding the front shoulder straps to form a second V-shaped strap.

6. The harness according to claim 3, further comprising a metal ring configured to ensure sliding of lower branches of the rear straps and the adjusting strap.

7. The harness according to claim 3, further comprising a metal adjusting buckle configured to provide a passage for upper branches of the rear straps and the adjusting strap.

* * * * *